US008251568B2

(12) United States Patent
Burkard

(10) Patent No.: US 8,251,568 B2
(45) Date of Patent: Aug. 28, 2012

(54) METHOD FOR PROCESSING A MATERIAL AND PACKING CONTAINER FOR CARRYING OUT THIS METHOD

(75) Inventor: Fritz Burkard, Maarssen (CH)

(73) Assignee: Sika Technology AG, Baar (CH)

( * ) Notice: Subject to any disclaimer, the term of this patent is extended or adjusted under 35 U.S.C. 154(b) by 0 days.

(21) Appl. No.: 13/064,383

(22) Filed: Mar. 22, 2011

(65) Prior Publication Data

US 2011/0170370 A1 Jul. 14, 2011

Related U.S. Application Data

(60) Division of application No. 11/822,112, filed on Jul. 2, 2007, now abandoned, which is a continuation of application No. 10/574,699, filed as application No. PCT/EP2004/052470 on Oct. 7, 2004, now abandoned.

(30) Foreign Application Priority Data

Oct. 7, 2003 (EP) ..... 03022442

(51) Int. Cl.
*B01F 3/12* (2006.01)
*B65D 25/08* (2006.01)

(52) U.S. Cl. ..... 366/130; 366/189; 366/348; 206/222

(58) Field of Classification Search ..... 366/130, 366/189; 206/219, 220, 222
See application file for complete search history.

(56) References Cited

U.S. PATENT DOCUMENTS

| | | | | |
|---|---|---|---|---|
| 3,430,815 | A | 3/1969 | Weimer | |
| 3,473,703 | A | 10/1969 | Lippincott | |
| 222,237 | A | 10/1971 | Schmit | |
| 3,860,219 | A * | 1/1975 | Nickerson, Jr. | 366/3 |
| 3,982,041 | A * | 9/1976 | Steen et al. | 426/618 |
| 4,343,398 | A | 8/1982 | Snyder et al. | |
| 4,401,214 | A | 8/1983 | Kleckers | |
| 4,470,703 | A * | 9/1984 | Nickerson, Jr. | 366/3 |
| 4,557,377 | A * | 12/1985 | Maloney | 206/219 |
| 4,650,452 | A | 3/1987 | Jensen | |
| 4,797,309 | A | 1/1989 | Kammerer et al. | |
| 4,818,544 | A * | 4/1989 | Seward | 383/103 |
| 4,837,849 | A | 6/1989 | Erickson et al. | |
| 4,903,718 | A | 2/1990 | Sullivan | |

(Continued)

FOREIGN PATENT DOCUMENTS

DE 89 07 795 U 8/1989

(Continued)

OTHER PUBLICATIONS

Apr. 12, 2011 Office Action issued in U.S. Appl. No. 11/822,112, 11 pages.

*Primary Examiner* — Tony G Soohoo
(74) *Attorney, Agent, or Firm* — Oliff & Berridge, PLC

(57) ABSTRACT

A method for processing a material, which is stored in a flexible packing container, comprises the following steps: At least one material or material mixture is fed to a first material or material mixture already located inside the packing container via a filling opening situated on the packing container; the filling opening is closed; the materials inside the packing container are mixed; a portion of the packing container is detached, and; the material mixture is processed via the resulting opening in the package container.

11 Claims, 1 Drawing Sheet

U.S. PATENT DOCUMENTS

| | | | | | |
|---|---|---|---|---|---|
| 4,998,646 | A | | 3/1991 | Sherman | |
| 5,052,554 | A | * | 10/1991 | Leonard | 206/219 |
| 5,312,189 | A | | 5/1994 | Aeschbach et al. | |
| D354,906 | S | | 1/1995 | Lane et al. | |
| 367,606 | A | | 3/1996 | Linner | |
| 5,618,105 | A | * | 4/1997 | Baker | 366/130 |
| 5,676,990 | A | | 10/1997 | Wawrzynski | |
| 5,795,071 | A | | 8/1998 | Sasaki et al. | |
| 5,937,617 | A | | 8/1999 | Yeager | |
| 5,941,642 | A | | 8/1999 | Darmstadter | |
| 6,076,664 | A | | 6/2000 | Yeager | |
| 6,077,208 | A | | 6/2000 | Larkin | |
| 6,131,806 | A | | 10/2000 | Hess, III et al. | |
| 6,209,754 | B1 | | 4/2001 | Suzumi | |
| 6,224,528 | B1 | | 5/2001 | Bell | |
| 6,245,367 | B1 | | 6/2001 | Galomb | |
| 6,254,907 | B1 | | 7/2001 | Galomb | |
| 6,854,888 | B1 | | 2/2005 | Brown et al. | |
| 6,935,783 | B2 | | 8/2005 | Carter | |
| 2003/0138169 | A1 | | 7/2003 | Bell | |
| 2003/0228336 | A1 | * | 12/2003 | Gervasio | 424/401 |
| 2009/0092711 | A1 | * | 4/2009 | Ninh et al. | 426/77 |

FOREIGN PATENT DOCUMENTS

| | | | |
|---|---|---|---|
| WO | WO 03/004379 | A1 | 1/2003 |
| WO | WO 03/062077 | A1 | 7/2003 |

* cited by examiner

METHOD FOR PROCESSING A MATERIAL AND PACKING CONTAINER FOR CARRYING OUT THIS METHOD

This application is a Divisional Application of U.S. patent application Ser. No. 11/822,112 (Abandoned), filed Jul. 2, 2007, which is a Continuation of U.S. patent application Ser. No. 10/574,699 (Abandoned), filed Apr. 5, 2006, which is the U.S. National Stage of PCT/EP2004/052470, filed Oct. 7, 2004, which claims priority from EP Application No. 03022442.2, filed Oct. 7, 2003. The disclosures of the prior applications are hereby incorporated herein by reference in their entirety.

BACKGROUND

1. Technical Field

The invention relates to a method for processing a material in a flexible parking container. The invention also relates to a packing container for processing a material.

2. Description of Related Art

It is often the case that materials, such as powdered materials, which are intended to be mixed with a second material, such as a liquid, for their processing, are sold in a bag. For the purpose of mixing with the second material, the bag is opened, and a quantity of the material to be mixed is put into a mixing vessel. After that, the second material or material mixture is added and the materials are mixed with one another in order to process the mixture further.

One example of such a material is concrete or mortar. The desired quantity of concrete or mortar is taken from the bag and put into a mixing vessel. For small quantities, a pot made of an elastic plastic material is normally used for this purpose. Water is then added as the second material and mixed intimately with a spatula, and the mixture is then processed by the spatula or a trowel. However, this procedure is complicated, in particular for handymen, and additional tools are needed.

In the foodstuffs sector, for example soups or creams in powdered form are sold in bags. In order to consume the products, the bag is opened and the powder is put into a container, where water or milk is then added, is stirred, and the product can then be eaten after a little while. The consumer of the products thus needs additional utensils in order to be able to prepare the products. For soup noodles, it is known to provide these in a pot made of hard plastic, where hot water can then be poured directly into this pot and the noodles can be consumed directly from the pot. However, these packs need a large volume and are very expensive.

SUMMARY

The invention is based on the object, in a method for processing a material and a packing container for processing the material, of avoiding the disadvantages of the prior art and of providing a method and a device which permit simple processing of the material without additional aids.

The invention is achieved by the features according to exemplary embodiments as described below.

The advantages of the invention can be realized that the materials can be mixed directly in the packing container, that is to say in the bag, and then the mixture can be processed directly in the bag. The bag has only small dimensions for the storage and thus takes up little storage space. Following the addition of other materials, the materials can be mixed directly in the bag after the latter has been closed. After the top part has been torn off, the mixture can be processed directly from the remaining, lower part of the bag. Thus, no other tools, that is to say containers, are needed. Following the processing of the mixture, the lower part of the bag with any mixture residues, which might remain, can be thrown away. Complicated cleaning of tools or containers is dispensed with, which simplifies the application considerably.

Further advantageous refinements of the invention emerge from the subclaims. For example, it is particularly expedient if the tool needed for the further processing of the mixture is arranged detachably on the bag.

BRIEF DESCRIPTION OF THE DRAWINGS

Exemplary embodiments of the invention will be explained in more detail based on the drawings. In the various figures, identical elements are provided with the same reference symbols.

DETAILED DESCRIPTION OF THE EMBODIMENT

Figure 1:
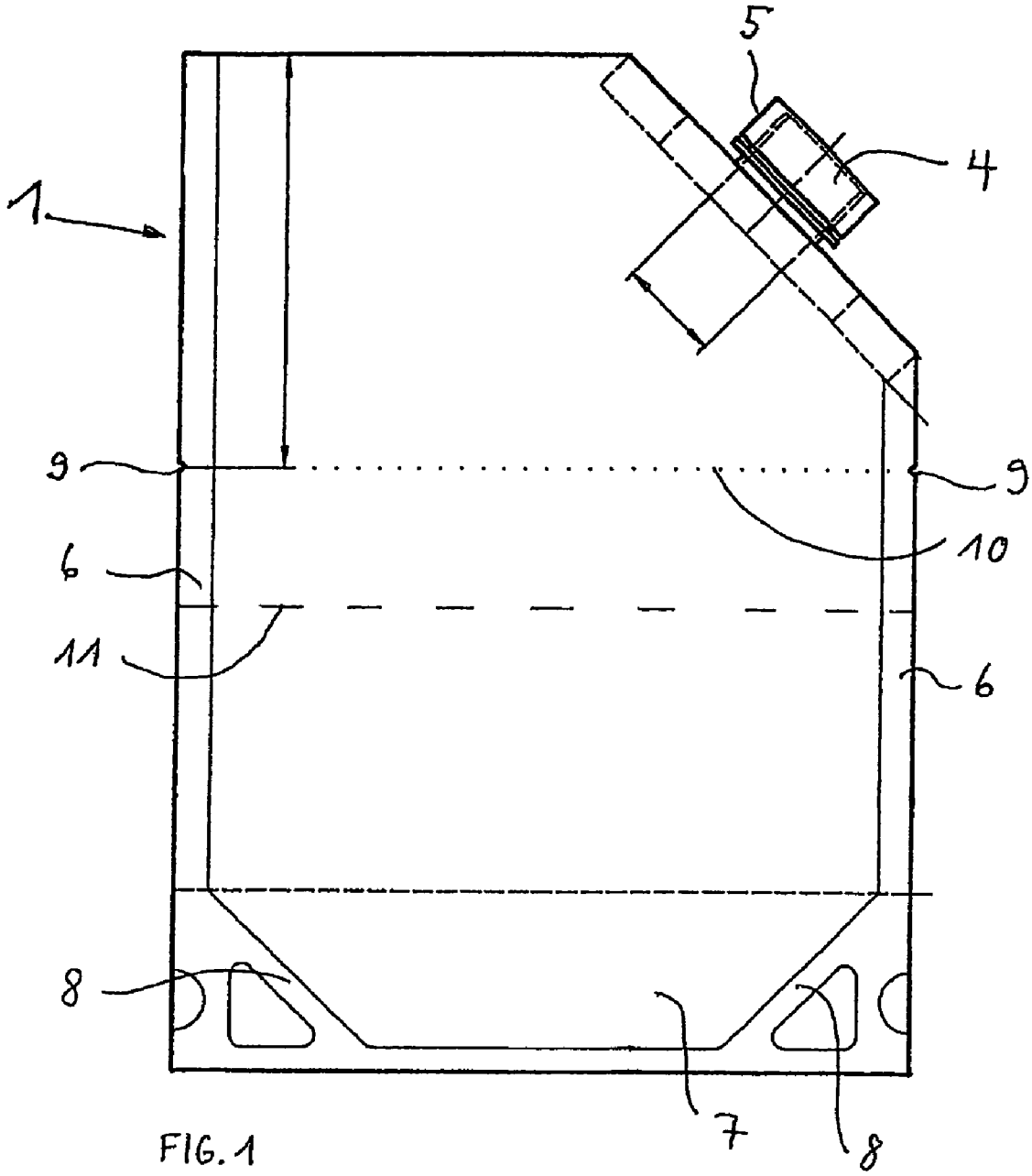
FIG. 1 shows a side view of a bag according to the embodiments.
Figure 2:
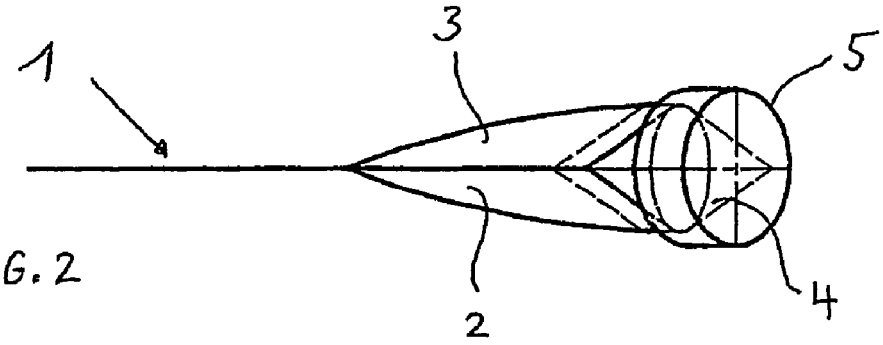
FIG. 2 shows a top view of a bag according to the embodiments without filling.

A packing container 1, such as a bag, for holding a material is shown in FIGS. 1 and 2. The bag 1 may include two wall elements 2, 3 and a closable opening 4. The opening 4 may be closed by a lid 5. The two wall elements 2, 3 may be connected circumferentially to each other and to the opening 4 by a welded seam 6, so that an internal space sealed off from the outside is produced. A bottom element 7 may additionally be arranged in the bottom region of the bag 1, such that the bag 1 stands securely, for example, on a table or rack. The bottom element 7 may be welded to the wall elements 2, 3 and may be welded to the wall elements 2, 3 by additional welds 8 in the corner regions of the bottom region, in order to reinforce and stabilize these corner regions.

Depending on the application, the wall of the bag may consist of various materials. Usually, a plurality of layers of different materials are combined for each wall element 2, 3 and bottom element 7. For example, the wall of the bag may consist of a polyethylene, which is laminated with polyethylene terephthalate (PET). If moisture-sensitive materials in particular are to be kept in the bag, additional vapor barriers may possibly be provided. The lid and the filling opening of the bag may be fabricated from polyethylene or polypropylene, for example. The welding of the bag may be carried out by known methods, for example, thermally or by ultrasound.

Underneath the filling opening, the bag may have a tear-open device including a notch 7 and a score 10 on the outer wall of the bag 1. The score may be produced by a laser but may also be carried out by a mechanical cutting device or other methods. The film of the bag may be scored but not cut through. The scoring may not be carried out so intensely and deeply that the bag tears along the scoring on its own but must be such that the bag can be torn open by hand.

Via the opening 4, the second material, for example water, is put in for the appropriate quantity. The quantity to be put in can be indicated by a filling mark 11 on the bag 1 but, depending on the bag content, it may also be more expedient to measure in advance the quantity of the second material to be added in and then to add it. The air may be then pressed out of the bag, and the bag may be closed with the lid and shaken and possibly kneaded until the desired thorough mixing has been achieved. After that, the bag may be torn open by the tear-open device, and the upper part may be torn off, it being possible for this part to be thrown away. Instead of tearing the bag open by the tear-open device, the tear-open device may also be omitted. The upper part of the bag may then, for example, be cut off by a cutting tool. A cutting mark may then be applied to the bag, in order that it is clear where the upper part be cut off.

The mixture obtained may then be processed, the remaining part serving as a processing container. By the bottom region, the remaining part stands securely, and the remaining part of the bag may have a cup shape. A spatula or another tool for processing the content of the bag may be arranged on the bag, for example, being adhesively bonded detachably to the outer side of the bag. By this spatula, the mixture may then be processed. Following the processing of the mixture, the bag may then simply be thrown away with the spatula. Thus, no additional tools are needed, nor do tools have to be cleaned.

The second material may also be supplied in a second bag at the same time, so that in each mixture an exact mixing ratio can be achieved. The use of a second bag may be advantageous in particular when the second material used is not water or materials which are similarly easily available. Following the addition of the second material from the second bag, or before this, a third material can also be added, for example, water or a material, from another bag. This may be advantageous in particular if, for example, in the event of premature mixing of different materials, the ability of the materials to be stored is reduced, for example, in order to avoid a premature chemical reaction. It goes without saying that any further desired substances may be added as described previously.

Following the addition of the second material and possible further materials from the second or further bags into the first bag, the procedure may be taken exactly as described above, if appropriate pre-mixtures can also be produced in the bags used.

EXAMPLE 1

For the application in the building sector, a powdered mortar or concrete mixture can be provided in the bag. Such mortar mixtures are generally known. As the second material, a previously measured quantity of water is added via the opening 4. After that, the excess air is pressed out of the bag, the bag is closed, and the bag is shaken and kneaded until an intimate mixture is produced. The upper part of the bag with the opening 4 is torn off by the tear-off device. A spatula fixed detachably to the bag has been removed from the bag before the addition of the water. By this spatula, the mortar mixture which is now ready to use can be processed directly from the remaining, lower part of the bag. Any possible residues of the mortar mixture are thrown away with the lower part of the bag.

EXAMPLE 2

Similar to example 1, a mortar mixture is provided in the bag. Concrete additives are provided in a second bag, which can have smaller dimensions than the first bag. First of all, water is now put into the second bag, the bag is closed, and the additives are dissolved or dispersed. After that, the content of the second bag is poured into the first bag and in any case filled with water as far as the filling mark. After that, the further procedure corresponds to example 1 and the mixture is processed.

EXAMPLE 3

For the cosmetics industry, for example a powdered face mask can be provided in the bag. Similar to example 1, water is added and mixed, and the mixture obtained in this way is processed directly from the bag, that is to say is applied. A spatula fitted to the bag can likewise be used for the application.

EXAMPLE 4

As an example from the foodstuffs industry, dried meals can be contained in the bag, for example, pasta with a powdered sauce. Warm or hot water is then added to the bag, is mixed and the upper part of the bag is removed. Using a fork and/or spoon detachably fixed to the bag, the meal can then be consumed directly from the remaining part of the bag after an appropriate waiting time.

EXAMPLE 5

A resin, for example, an epoxy resin, is provided in a first bag. A hardener is provided in a second, smaller bag. The hardener is poured from the second bag into the first bag, the first bag is closed after the air has been pressed out. After that, the first bag is shaken and possibly kneaded in order to achieve an intimate mixture. The upper part of the bag with the opening 4 is torn off by the tear-off device. A spatula detachably fixed to the bag has been removed from the bag before the addition of the hardener. By this spatula, the resin mixture, which is now ready to use, can be processed from the bottom part of the bag. Any residues of the resin mixture are thrown away with the lower part of the bag.

Of course, the invention is not restricted to the exemplary embodiments shown and described. The bag according to the invention is suitable for all possible materials and can be used wherever two or more materials may be mixed with each other, and the mixture then may be processed. Thus, the invention can be used in any desired areas of application.

The invention claimed is:

1. A method for processing a material which is kept in a flexible packing container, comprising:

adding at least one of a second material and a material mixture to at least one of the material or a second material mixture arranged in the packing container via a filling opening provided on the packing container, closing the filling opening with a detachable cover;

mixing contents of the packing container;

processing the contents of the packing container via the filling opening formed in the packing container;

detaching a first part of the packing container from the packing container, the first part of the packing container includes the detachable cover; and mixing the contents of the packing container in a second part of the packing container, the second part of the packing container having a base with a cup shape that stands independently and securely.

2. The method as claimed in claim 1, further comprising:

detaching the first part of the packing container by tearing off the first part of the packing container from the packing container using a tear-off device.

3. The method as claimed in claim 1, further comprising:

processing the contents of the packing container directly from the packing container.

4. The method as claimed in claim 1, further comprising:

removing excess air from the packing container before the packing container is closed.

5. The method as claimed in claim 1, further comprising: filling the packing container with the second material up to a filling mark of the packing container.

6. The method as claimed in claim 1, further comprising: adding the second material from an other packing container into the packing container via the filling opening.

7. The method as claimed in claim 6, further comprising: adding at least one of a third material and a third material mixture to the second material before adding the second material into the packing container.

8. The method as claimed in claim 7, further comprising: mixing the second and third material or the second and third material mixture in the other packing container before being put into the packing container.

9. The method as claimed in claim 1, further comprising: disposing of the packing container after the processing of the contents of the packing container.

10. The method as claimed in claim 1, further comprising: removing a fixed detachable spatula from the packing container for processing the contents of the packing container.

11. The method as claimed in claim 1, further comprising: using the contents of the packing container in at least one of an automotive industry, construction industry, foodstuffs industry, cosmetics and health sector, medical and pharmaceutical sector and agricultural industry.

* * * * *